US005924226A

United States Patent [19]

Zuber

[11] Patent Number: 5,924,226

[45] Date of Patent: Jul. 20, 1999

[54] FOLDABLE IRONING BOARD WITH LEG LATCH

[75] Inventor: Gerhard Zuber, Meckesheim, Germany

[73] Assignee: Leifheit AG, Nassau, Germany

[21] Appl. No.: 09/022,271

[22] Filed: Feb. 11, 1998

[30] Foreign Application Priority Data

Feb. 15, 1997 [DE] Germany ..... 197 05 887
Mar. 18, 1997 [DE] Germany ..... 297 04 693

[51] Int. Cl.[6] ..... D06F 81/02

[52] U.S. Cl. ..... 38/137; 38/DIG. 3

[58] Field of Search ..... 38/DIG. 1, DIG. 2, 38/DIG. 3, 137, 138, 139

[56] References Cited

U.S. PATENT DOCUMENTS

| | | | |
|---|---|---|---|
| 1,359,527 | 11/1920 | Reed | 38/DIG. 3 |
| 1,692,599 | 11/1928 | Wenzel . | |
| 2,101,597 | 12/1937 | Rich | 38/DIG. 3 |
| 2,162,672 | 6/1939 | Johannsen . | |
| 2,424,734 | 7/1947 | Booth | 38/137 X |
| 2,482,957 | 9/1949 | Willens . | |
| 2,912,775 | 11/1959 | Gettelman . | |
| 3,021,628 | 2/1962 | Cillo | 38/139 X |
| 3,202,389 | 8/1965 | Zoffer . | |
| 3,206,881 | 9/1965 | Kleinsorge | 38/137 |
| 3,698,110 | 10/1972 | Shettel | 38/107 |
| 4,918,845 | 4/1990 | Livecchi . | |
| 5,335,432 | 8/1994 | Simpson | 38/DIG. 3 |

FOREIGN PATENT DOCUMENTS

| | | |
|---|---|---|
| 2253347 | 6/1975 | France . |
| 86 05 722 U | 6/1986 | Germany . |
| 96 01 268 | 9/1996 | Germany . |
| 195 26 637 A1 | 1/1997 | Germany . |

OTHER PUBLICATIONS

Leifheit, Hassen Sie Hemdenbügeln?.

*Primary Examiner*—Ismael Izaguirre
*Attorney, Agent, or Firm*—Frishauf, Holtz, Goodman, Langer & Chick

[57] ABSTRACT

To provide an ergonometrically correct ironing board (2) which can be readily folded and retained in folded position, the legs (7, 8) of the ironing board are coupled at a cross-over shaft (9) and each connected to a spacer element (18, 19) in which the spacer element is formed with a recess or groove or notch (17). A hand-operable height-positioning lever (15) which is coupled to a height adjustment mechanism (5, 4, 12, 13, 14) is also coupled to a locking lever (16) having a locking tip (22) engageable with the recess or groove or notch (17) in the spacer elements which are coupled to the legs (7, 8) when the legs are folded together. The locking lever (16) is spring-loaded to retain the legs in folded position; upon operating the height positioning lever (15), the lock is automatically released. For universal ironing convenience, the ironing board has a straight front side (67) which has a curved blunt end (69) with a curve radius of about 350 mm. It merges over more sharply curved corners with the front side (67) and a backside (61) which has a first, straight portion (65) of at least half the length as the front side (67) and which then merges over a gentle bend (66) with a pointed tip end (64) of the ironing board. All corners are rounded, with curve radii of, for example, about 65 mm.

21 Claims, 5 Drawing Sheets

FOLDABLE IRONING BOARD WITH LEG LATCH

Reference to related application and patents, the disclosures of which are hereby incorporated by reference:

U.S. Ser. No. 09/022,270, filed Feb. 11, 1998, ZUBER.

U.S. Pat. No. 1,692,566, Wenzel

U.S. Pat. No. 2,482,957, Willens

U.S. Pat. No. 2,912,775, Gettelman

U.S. Pat. No. 3,202,389, Zoffer

U.S. Pat. No. 4,918,845, Livecchi

Reference to related patent disclosures:

German 195 26 637 A1

German G 86 05 722.7 U1

German Design Model M 96 01 268.

FIELD OF THE INVENTION

The present invention relates to a foldable ironing board which has an ironing board surface on which a padding can be placed, and two support legs which, in erected position of the ironing board, have essentially X shape, the legs being coupled to the ironing board surface.

BACKGROUND

To permit storing and transporting of an ironing board having legs folded against the board, it has been proposed to provide hooks or the like on the ironing board, usually on the bottom of the ironing surface, in order to lock the leg structure in folded position. The hook reaches beneath a portion of the ironing board or its leg structure to ensure that the board with the legs folded will remain in the folded condition. Such transport or storage hooks and lock structures are awkward to use and require additional material and assembly in the manufacture of the ironing board.

The ironing board surface usually is arranged in form of an elongated plate with essentially parallel sides. One end or one side is usually widened and blunt in order to provide a rest position for a flat iron; the other end tapers toward a pointed tip. German Utility Model G 86 05 722 describes such a structure.

U.S. Pat. No. 2,917,775 describes a folding mechanism; German Design Model M 96 01 268 and the U.S. patent describe ironing boards with one longitudinal side straight and a more or less curved back side. At least at one side, a somewhat slim run-out is thus provided. The ironing board of the German Design Model M 96 01 268 is in general of "banana" shape. Upon ironing with this ironing board, the user's arm movements are facilitated by this "banana" shape only if large items are to be ironed on the board.

The shapes of the various ironing boards are matched for convenient ironing usually only for a very restricted type of laundry to be ironed, for example for large-area goods such as sheets or the like, or small regions, such as arms of shirts. Substantial compromises must be made by the user when ironing on such boards. A convenient place for the iron, when not is use, is not provided on any one of these ironing boards.

THE INVENTION

It is an object to provide an ironing board which is convenient to use in a household, considering the aspects of storage of the ironing board when not in use, as well as the ease of use of the ironing board when ironing various articles, customarily handled in a home, by arranging a lock for the ironing board legs, when in collapsed condition, which is easy to use, and readily manufactured, and to shape the ironing board surface to permit optimal ironing, considering ergonometric adaptability for the user, and which, further, permits integration of a hot iron rest with the ironing board likewise based on ergonometric considerations to ensure convenience for the user.

Briefly, according to a feature of the present invention, the height adjustment mechanism of the ironing board and a leg lock are interconnected. The leg lock includes two spacer elements, in the form of thick spacer washers, which are placed on a shaft connecting the legs of the ironing board at an intersection or X cross-over of the legs. The spacer elements are coupled to the legs and formed with a recess or notch so located that when the ironing board is in folded or collapsed condition, the recesses are in alignment, so that they can be engaged by a locking lever. The locking lever is coupled to a height adjustment lever of the height adjustment mechanism. By coupling together the height adjustment mechanism and the lock for the legs, automatic locking of the legs upon collapsing the ironing board legs against the bottom of the ironing board surface is automatically attained, while permitting easy release and re-adjustment of a convenient height position when unfolding the legs.

The ironing surface of the ironing board has a blunt end, preferably left of the front side, and a pointed end. One of the sides, which may be a front side, is essentially straight; the back side, in accordance with a feature of the invention, extends essentially parallel to the front side over at least half the length of the ironing board and then merges with the pointed end with a gentle curve or bend; an ironing rest is removably and selectively repositionable on the ironing board so that the iron rest itself can be located at any place convenient for the user, regardless of whether the user is right-handed or left-handed.

By coupling the height adjustment mechanism with the locking mechanism, manufacturing costs are substantially reduced and locking is automatic, while also automatically unlocking the legs when the ironing board is to be erected and positioned, including height, in accordance with the convenience of the user. No precision parts are necessary, and manufacturing tolerances can readily be compensated for by providing inclined or chamfered surfaces at the leg-locking arrangement. A metal disk can, additionally, be interposed between the spacer elements to reduce wear-and-tear and further facilitate folding and unfolding.

The leg-locking arrangement as well as the surface of the ironing board are specifically designed from ergonometric points of view, permitting articles to ironed in optimum manner while also ensuring that both the ironing board as well as the iron rest are properly positionable for the convenience of the user. It has been found that generally only one-third of articles to be ironed have straight edges; the particular shape of the ironing surface, thus, is matched to the average of the goods to be ironed. A long straight-line front side permits ironing, without wrinkling of freshly ironed surfaces. The gently bent or bowed portion of the back surface is optimally arranged for ironing of articles which are most frequently ironed, namely blouses and shirts. The ironing board can be used for ironing around the shoulders and the curved shoulder surfaces of blouses and shirts; those regions were heretofore always difficult to iron and often required separate and smaller ironing boards. This is inconvenient in use and requires extra storage space.

The ironing board in accordance with the present invention, thus, permits ironing a larger variety of goods in one ironing operation, and thereafter for storage reliable locking of collapsed legs. The pointed end, with the merging gently curved surface is particularly suitable for ironing of smaller, narrower articles such as skirts, legs of trousers or slacks, and other similarly shaped and formed articles. For optimal use of the specifically shaped sides and edges of the ironing board, it is also necessary to ergonometrically correctly place a rest for the iron being used in relation to the particular article then being ironed, or intended to be ironed next. The simplest form to permit placing the iron at any desired space would be to make the ironing board cover sufficiently heat resistant so that it is possible to park the iron at practically any position of the ironing board. This, however, is not suitable from points of safety and costs because it can easily be forgotten that a hot iron has been at a particular place for some time, which may cause overheating and burns. It is thus necessary to provide a specific rest for the iron, which rest can be suitably placed. In accordance with the present invention, the iron rest can be clamped, e.g. from below, to the ironing board at any desired position. It is thus possible, with a simple hand operation, to place the iron rest as desired at any place around the circumference of the ironing board. This, also, makes it possible to permit the ironing board to be optimally used by both right and left-handed users.

The legs, preferably, are not straight but bent in shallow C shape. This facilitates placement of the user's knees when ironing in sitting position.

Investigations have determined that for average users certain dimensions are particularly suitable. Of course, specific measurements can deviate from those which will be described below, without departing from the scope of the present invention; yet, the relative dimensional relationships are ergonometrically particularly suitable.

DRAWINGS

DETAILED DESCRIPTION

Figure 1:
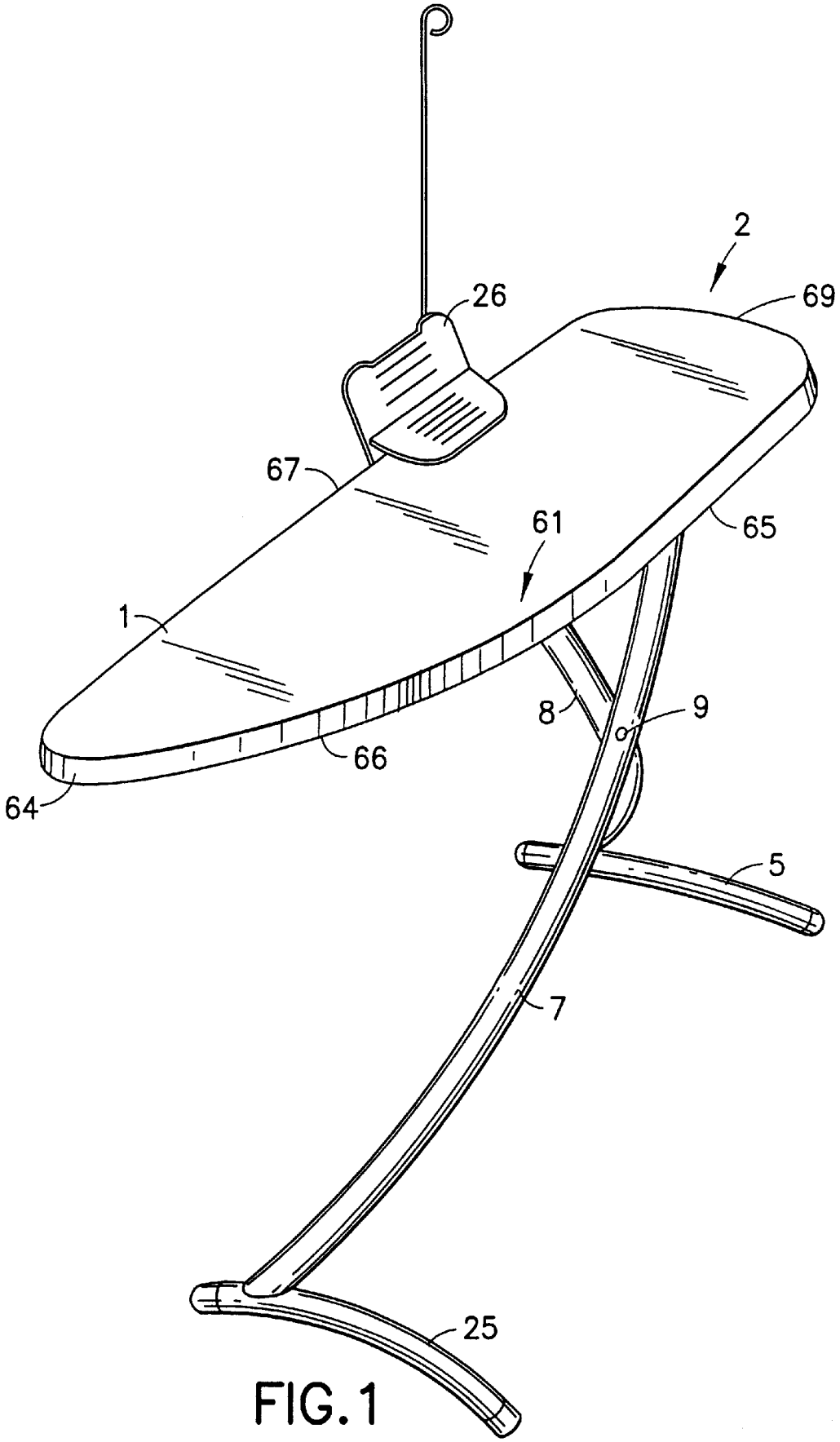
FIG. 1 is a highly schematic perspective view of the ironing board, from the back side, with an iron rest in a selected position.

The ironing board, generally shown at 2, has an ironing board surface or ironing plate 1. It is supported by two legs 7, 8, which in erected position form a general X shape. The legs 7, 8 are connected at a connecting shaft 9. The height adjustment mechanism of the table has been purposely omitted in FIG. 1, for ease of illustration. The legs 7, 8 have cross end pieces 25, preferably terminating in shock-absorbent plastic or rubber cups. The legs 7, 8 form a shallow C. An iron rest 26 is removably and repositionably clamped to the ironing board surface 1. The referenced copending application Ser. No. 09/022,270, filed Feb. 11, 1998, by the inventor hereof, discloses suitable and preferred clamping arrangements: one embodiment using a clamping eccenter coupled to an operating lever is schematically shown at 26*a*. The operating lever is accessible from the side of the ironing board 2.

Figure 2:
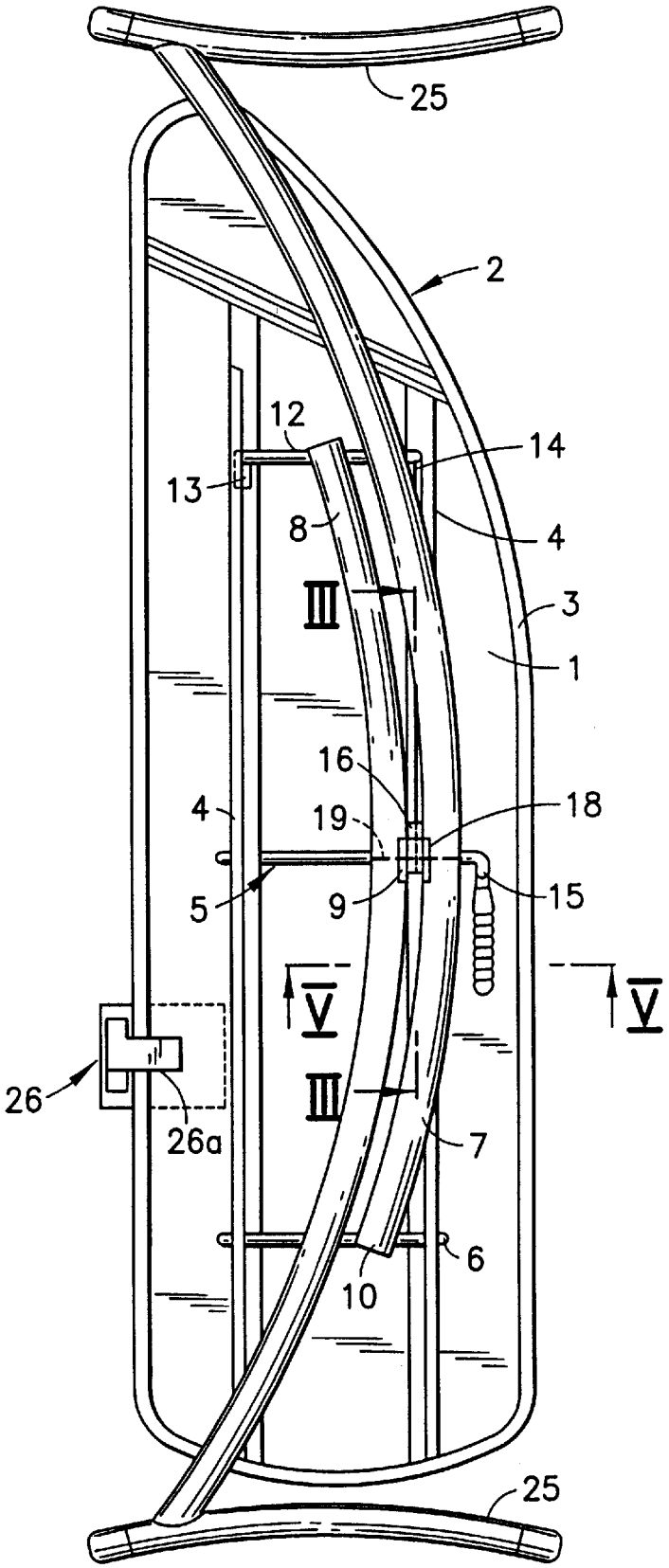
FIG. 2 is a bottom view of the ironing board, with the legs of the ironing board collapsed.

The ironing board 2 essentially includes the ironing plate 1, seen at the back side in FIG. 2, with a frame 3 extending therearound and projecting downwardly—when the ironing board is erected—from the ironing board surface 2. The ironing board has two longitudinally extending rails 4 which receive a height adjustment mechanism 5 and a pivot axis 6, on which the leg 7 is pivotably retained. The legs 7 and 8 are coupled by their connecting shaft 9 at the cross-over point of the X. The leg 7, at its end portion 10, is pivotably retained on the shaft 6. The leg 8 is coupled to a cross element 12 which is slidable in the channel-shaped rail 4 (FIG. 5), and forming part of the height adjustment mechanism 5. The connection between the leg 8 and shaft 12, likewise, is pivotable. A slider 13 is coupled to shaft 12 and to a rod 14. Rod 14 is coupled to a height adjustment lever 15, which lever can lock, or clamp or release the rod 14, to thereby lock the legs 7 and 8 in height adjusted position, as is well known in ironing board constructions.

In accordance with a feature of the invention, a leg-locking lever 16 is coupled to the height adjustment lever 15, e.g. by common shaft 1516.

Figure 3:
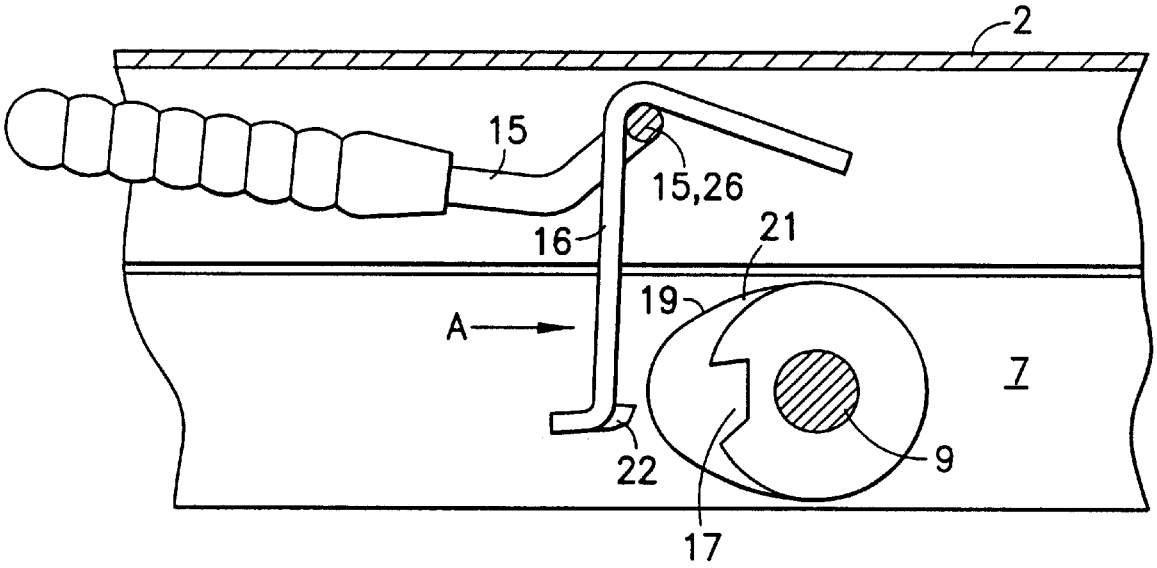
FIG. 3 is a cross section along line III—III of FIG. 2.
Figure 4:
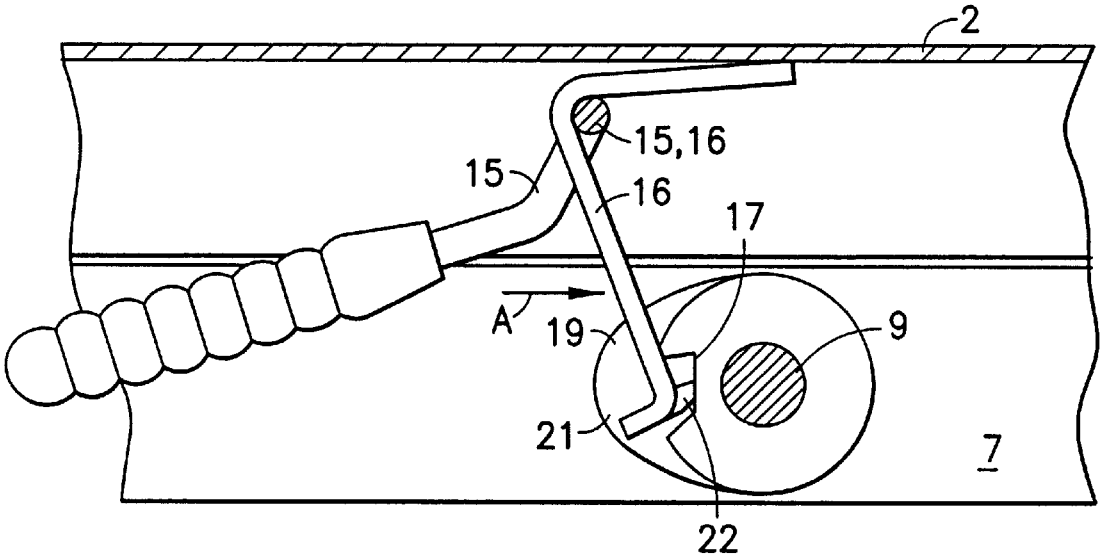
FIG. 4 is a view similar to FIG. 3, but showing the leg lock in locked position.
Figure 5:
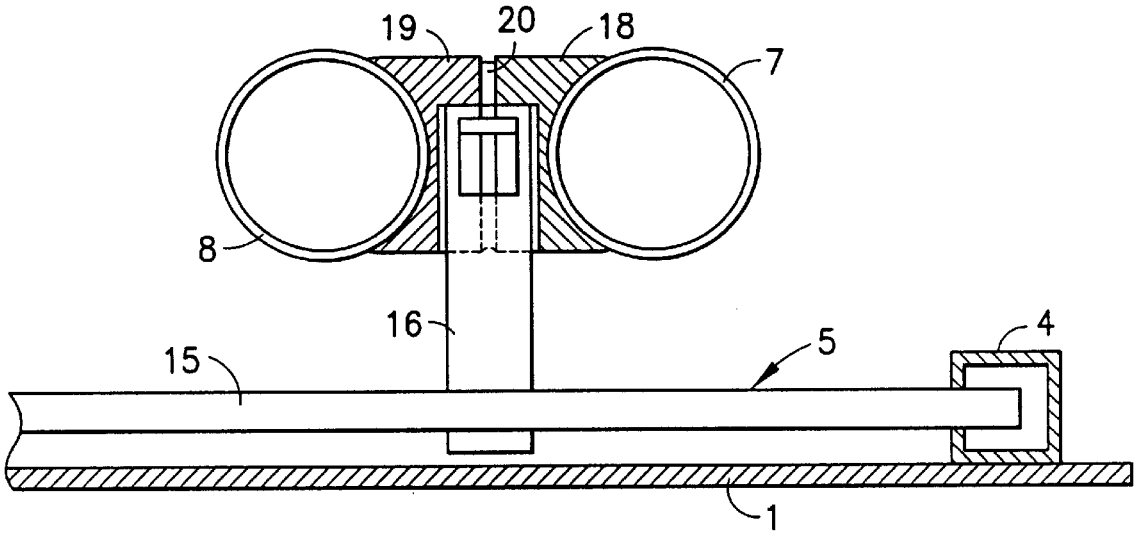
FIG. 5 is a cross section along line V—V of FIG. 2.
Figure 6:
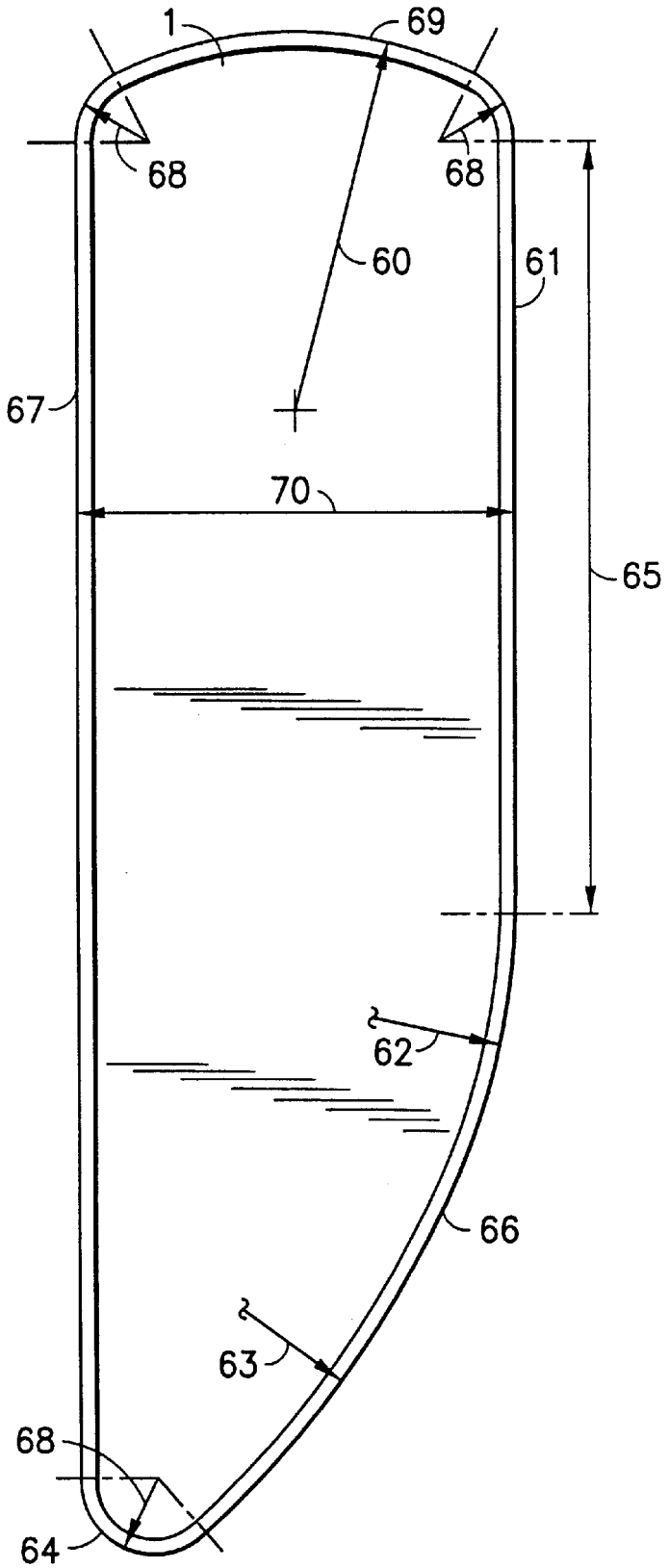
FIG. 6 is a top view of the ironing board surface of the ironing board in accordance with the present invention.

The coupling of the rod 14 to the height adjustment lever 15, and clamping thereof, which is well known, has been omitted from the detailed drawings of FIGS. 3–5 for ease of illustration. The locking lever 16 has a tip 22 which can engage in a groove 17, as best seen by comparing FIGS. 3 and 4, of two spacer elements, typically spacer disks 18, 19. Elements 18, 19 are located on the shaft 9; each one of the spacer elements 18, 19 has the groove 17 formed therein. The spacer elements 18, 19 are, respectively, coupled and connected to a respective leg 7, 8 and rotate about shaft 9 when the legs 7, 8 are collapsed from an erected position. A metal disk 20 is located between the spacer elements 18, 19. Metal disk 20 also is formed with the groove 17, and is coupled to one of the two spacer elements 18, 19. The spacer elements 18, 19, in the region of the groove, are chamfered or formed with an inclined surface 21 (see FIG. 4) leading to groove 17. The spacer elements 18, 19 are not necessarily circular, but in plan view can be oval as shown (see FIGS. 3, 4).

FIG. 3 illustrates the legs in collapsed condition, with the lock in locked position. The locking lever 16 is formed with the projecting engagement tip 22 which engages into the groove 17. A spring, e.g. a leaf spring (not shown), provides spring force in the direction of the arrow A to engage the projection or tip 22 into the grooves 17. This locks the spacer elements 18, 19 as well as the metal disk 20 together, retaining the legs 7, 8 in position against the underside of the ironing board surface 2, that is, in folded, locked position. When it is desired to place the ironing board in operative, raised position, lever 15 is operated which, at the same time, controls the height adjustment mechanism via rod 14. Moving the handle 15, and with it lever 16, counter the spring force A releases the projecting tip 22 of the locking lever 16, so that the legs 7, 8 can spread apart, leg 8 sliding longitudinally via the connection of slider 13 in the rail 4. Upon refolding of the ironing board, the locking lever 16 is automatically engaged in the grooves 17, or one of them, being guided by the inclined surface 21, so that the folded legs are automatically locked against the underside of the ironing board surface.

In accordance with a feature of the invention, and to make the ironing board particularly ergonometrically acceptable as well as useful for many ironing tasks, the ironing board has a front side 67 (FIG. 7) which merges into a blunt but curved back end 69 with a sharply rounded—with respect to the curve of the back end 69—corner. The corner has a curve radius, shown at 68, of about 65 mm. The radius of the curved, blunt end is shown at 60 and, suitably, is about 350 mm. The curved end 69 merges with another rounded corner with the back side 61. The radius between the back side 61 and the end 69 is again about 65 mm and thus shown at 68. The back side 61 has a longitudinal portion 65 of about 700 mm, if the entire length of the ironing board is about 1.4 m, and its width 70 about 0.4 m. The straight portion 65 of the back side 61 continues in a curved or bent portion 66. The radius of the curved portion 66 varies, first having a radius shown at 62 of about 700 mm, and then, with a slightly shallower radius 63 of about 1000 mm, terminating in a more pointed tip 64 with radius 68 of, again, 65 mm, to merge with the front side 67. The length of the portions of the respective radii 62, 63 can be suitably selected; for example, the length of the portions of the respective radii 62, 63 can be approximately equal or, as shown, the length of the portion of radius 62 can be slightly longer than that of the portion of radius 63.

The dimensions given, of course, are approximate and can vary as desired; for smaller boards, the dimensions as well as the radii can be made also somewhat smaller or retained, except for the length and width dimensions as desired. The dimensions given are particularly suitable for average household use.

High adjustment arrangements for ironing boards are well known. As an example, one mechanism is described and shown in detail in U.S. Pat. No. 2,912,775 to Gettelman, the disclosure of which is hereby incorporated by reference. The handle and lever 15 of the present invention generally corresponds to the handle 72 and lock 68 of the Gettelman U.S. Pat. No. 2,912,775 (see particularly FIGS. 3 and 4).

Various changes and modifications may be made and any features described herein may be used with any of the others, within the scope of the inventive concept.

I claim:

1. Foldable locking ironing board with a folded portion lock, said foldable board comprising:

an ironing board surface (2);

two support legs (7, 8) which, in erected position of the ironing board, have substantially X shape, said legs being coupled to said ironing board surface;

a connecting shaft (9) connecting said legs at a cross-over of the X;

a height adjustment mechanism (5, 4, 12, 13, 14) including a manually operable adjustment lever (15), said height adjustment mechanism effecting coupling of one of said legs (8) to the ironing board in a predetermined position;

a leg-locking arrangement (16, 17, 22); and a coupling means (1516) coupling together said leg-locking arrangement (15, 17, 22) and said height adjustment mechanism (5, 4, 12, 13, 14), said locking lever (16) being operable to automatically lock said legs together when the ironing board is in collapsed condition, and said leg-locking arrangement automatically releasing said lock upon operation of the height adjustment lever (15); and wherein the leg-locking arrangement comprises two spacer elements (18, 19) on said connection shaft (9), one each coupled to one of said legs (7, 8) and interlocked with a respective leg;

said spacer elements (18, 19) each having a recess (17) or groove or notch thereon, located on the respective spacer element such that, when the ironing board is in folded condition, said recesses or grooves or notches (17) are in alignment; and wherein the locking lever (16), coupled to said height adjustment lever (15) of the height adjustment mechanism (5, 4, 12, 13, 14), is engageable with at least one of said recesses (17) when they are in alignment.

2. The ironing board of claim 1, wherein said spacer elements (18, 19) are formed with a chamfered or inclined surface (21) leading to the respective recess or groove or notch (17) thereon.

3. The ironing board of claim 1, further including a disk or washer (20) coupled to one of said spacer elements (18, 19), said disk or washer (20) being formed with a recess or groove or notch (17) in alignment with the respective recess or groove or notch on the respective spacer element to which the disk or washer is coupled.

4. The ironing board of claim 1, wherein said locking lever (16) is formed with a projection or projecting tip (22) engageable in said at least one recess or groove or notch (17).

5. The ironing board of claim 4, wherein said projection or projecting tip (22) is engageable with all the recesses (17) in said spacer elements (18, 19).

6. The ironing board of claim 1, wherein the legs (7, 8) are essentially C-shaped, with the open side of the C facing the front side (67) of the ironing board.

7. The ironing board of claim 1, wherein said ironing board has an ironing board surface which has a first, blunt end (69) and a second pointed end (64);

an essentially straight front side (67) and a back side (61) extending between said first and second ends, and remote from said front side (67);

wherein said back side (61) has an essentially straight portion (65) extending over at least half of the length of the back side, and a gently curved or bent portion (66) merging with the pointed end (64); and wherein said first, blunt end (69) is curved with a radius (60) of approximately 350 mm, and merges by means of at least one sharply curved portion (68) with said essentially straight one side (67) and said essentially straight portion (65).

8. The ironing board of claim 7, wherein the gently curved portion (66) of the back side has a first region having a radius of about 700 mm and a second region having a radius of about 1 m, said second region connecting the first region to the tip end (64) of the ironing board.

9. The ironing board of claim 7, wherein the second pointed end is curved with a radius (68) of about 65 mm.

10. The ironing board of claim 7, wherein the first blunt end (69), with respect to the top side (2) of the ironing board, is at the left side of the front side (67).

11. The ironing board of claim 7, wherein the longitudinal dimension of said ironing board surface (2) is approximately 1.4 m long and 0.4 m wide; and wherein said essentially straight portion (65) of the back side (61) has a length of about 700 mm.

12. The ironing board of claim 7, in combination with a flat iron rest (26), which flat iron rest is selectively removable or positionable at any random location on said ironing board surface (2); and wherein said ironing rest (26) is clampable to the ironing board surface (2), from below the ironing board, at any selected position.

13. The ironing board of claim 7, wherein said sharply curved portion has a curve radius of about 65 mm (68).

14. Foldable ironing board having an ironing board plate (2), said ironing board plate having a first, blunt end (69) and a second pointed end (64);

two support legs (7, 8) which, in erected position of the ironing board, have substantially X shape;

wherein said ironing board has a front side (67) which is essentially straight; a back side (61) having an essentially straight portion (65) extending essentially parallel to said front side over at least half the length of said first front side, and a curved portion (66) merging with the pointed end (64) over a gentle curve or end; and wherein said first, blunt end (69) is curved with a radius (60) of approximately 350 mm, and merges with at least one of said essentially straight front side (67) and said essentially straight portion (65) with a sharply curved portion (68).

15. The ironing board of claim 14, wherein the gently curved portion (66) of the back side has a first region having a radius of about 700 mm and a second region having a radius of about 1 m, said second region connecting the first region to the tip end (64) of the ironing board.

16. The ironing board of claim 14, wherein the second pointed end is curved with a radius (68) of about 65 mm.

17. The ironing board of claim 14, wherein the first, blunt end (69), with respect to the top side (2) of the ironing board, is at the left side of the front side (67).

18. The ironing board of claim 14, wherein the longitudinal dimension of said ironing board surface (2) is approximately 1.4 m long and 0.4 m wide; and wherein said essentially straight portion (65) of the back side (61) has a length of about 700 mm.

19. The ironing board of claim 14, wherein the legs (7, 8) are essentially C-shaped, with the open side of the C facing the front side (67) of the ironing board.

20. The ironing board of claim 14, in combination with a flat iron rest (26) which flat iron rest is selectively removable or positionable at any random location on said ironing board surface (2); and wherein said ironing rest (26) is clampable to the ironing board surface (2), from below the ironing board, at any selected position.

21. The ironing board of claim 14, wherein said sharply curved portion has a curve radius of about 65 mm (68).

* * * * *